United States Patent [19]

Keglewitsch

[11] 4,230,391

[45] Oct. 28, 1980

[54] ELECTRICAL CONTACT

[75] Inventor: Josef Keglewitsch, Addison, Ill.

[73] Assignee: Bunker Ramo Corporation, Oak Brook, Ill.

[21] Appl. No.: 938,995

[22] Filed: Sep. 1, 1978

[51] Int. Cl.[3] ..... H01R 9/08

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 2,333,266 | 11/1943 | Miller | 339/97 R |
| 3,027,536 | 3/1962 | Pasternak | 339/97 R |
| 3,636,500 | 1/1972 | Sedlacek | 339/97 R |
| 3,910,672 | 10/1975 | Frantz | 339/97 P |
| 4,017,140 | 4/1977 | Reavis, Jr. et al. | 339/98 |

*Primary Examiner*—Joseph H. McGlynn

*Attorney, Agent, or Firm*—F. M. Arbuckle; J. R. Hoffman

[57] ABSTRACT

An electrical contact is disclosed for termination to an electrical conductor. The contact includes a body portion having an active contact element at one end for engagement with a compatible contact and a terminal element at the other end adapted to be terminated to a conductor. The terminal element includes a pair of elongated, spaced conductor engaging arms having inside edges which define a uniformly tapered, inwardly diverging slot extending from the distal end of the terminal element for receiving the conductor. The inside edges of the arms are beveled for piercing insulation about the conductor. The arms have a generally uniform cross section extending substantially the length of the slot. The slot cooperates with the arms to provide substantially uniform normal forces on the conductor as the conductor is moved inwardly along the slot for termination purposes. An enlarged mouth is provided at the distal end of the terminal element, in communication with the tapered slot, for dressing the conductor into the mouth prior to terminating the conductor within the slot.

26 Claims, 7 Drawing Figures

ELECTRICAL CONTACT

BACKGROUND OF THE INVENTION

The present invention is directed to an electrical contact for termination to an electrical conductor, and, more particularly, the invention relates to an electrical contact having a generally planar terminal element which is designed for piercing insulation disposed about the conductor, generally perpendicular to the axis of the conductor.

Crimp-type electrical contacts are well known in the art and have been developed for termination with electrical conductors without the need of solder or other fastening means. One form of crimp contact constitutes a ferrule-type of crimp wherein the crimping means encircles the conductor along the axis thereof, with the active element of the contact extending in the same plane as the axis of the conductor, and with the crimping means clamped directly onto the conductive portion of the conductor. One disadvantage attendant to such a crimp contact is that upon repeated engagement of the active element of the contact with a compatible contact, the crimp termination may tend to loosen, thus impairing or breaking the circuit intended to be achieved thereby. Moreover, such contacts generally require a crimping tool having an anvil portion to appropriately grasp and support the contact, in which event such contacts must be preassembled to the conductor by the tool prior to mounting in a connector housing.

Another form of crimp-type electrical contact includes insulation piercing arms or fingers which are driven through the insulation about the conductor to establish electrical contact with the internal conductive portion of the conductor. Most often, a tool is required to deform the insulation piercing arms or legs of the contact to drive the arms through the insulation. The problem with such crimping contacts or techniques is that there always is the possibility that the insulation piercing arms or fingers will be driven by excessive forces not only through the insulation about the conductor, but into the electrical conductive portion of the conductor damaging the conductive portion or interfering with the electrical path therethrough.

It has been proposed to terminate an insulated conductor to an electrical contact simply by driving the conductor between stationary insulation piercing arms of the contact without actually deforming the arms themselves, as with crimping. However, a problem with such techniques is that the piercing forces of the arms increase considerably as the conductor is moved into the slot therebetween and, again, the piercing arms or fingers are prone to cut too deeply into the conductor. In addition, with repeated use of the contact, the varying and sometimes excessive forces utilized in opening and closing the arms results in a "set" in the arms whereupon the arms lose their resiliency.

The present invention is directed to providing an electrical contact which is designed to overcome the above specific and other problems involved with such electrical contacts heretofore known in the art.

SUMMARY OF THE INVENTION

Accordingly, the present invention is directed to a new and improved electrical contact for termination to an electrical conductor.

More particularly, in the exemplary embodiment of the invention, an electrical contact for termination to an electrical conductor is disclosed and includes a body portion stamped from generally flat sheet metal material or the like and has an active contact element at one end for engagement with a compatible contact, and a terminal element at the other end adapted to be terminated to a conductor, such as an insulated electrical wire. The terminal element includes a pair of elongated, spaced conductor engaging arms having inside edges which define an elongated, uniformly tapered, inwardly diverging slot extending inwardly from the distal end of the terminal element for receiving the conductor. The tapered conformation of the slot is effective to preclude excessive forces of the arms of the conductor as the conductor is progressively moved into the slot to terminate the contact to the conductor. The inside edges of the arms are beveled to provide insulation piercing means on the arms for piercing insulation about the conductor. The arms have a generally uniform cross section extending substantially the entire length of the tapered slot. The slot cooperates with the arms to provide substantially uniform normal forces on the conductor as the conductor is moved inwardly along the slot for termination purposes.

An enlarged mouth is formed in the contact at the distal end of the terminal portion thereof, between the insulation piercing arms and in communication with the tapered slot. The mouth provides means for dressing a conductor into the mouth prior to termination of the conductor within the slot, such as dressing a plurality of insulated wires onto an array of electrical contacts mounted on an appropriate housing, such as a panel or the like. The conductors then can be terminated to the entire array of contacts in a single operation.

In the form of the invention disclosed herein, the electrical contact includes an intermediate portion between the active contact portion and the terminal portion. The intermediate portion includes mounting means for facilitating mounting the contact onto a panel or the like. Herein, the mounting means includes notches in the sides of the contact for snap fit into an appropriate aperture or the like in the panel. Detent means is provided on the intermediate portion adjacent the notches for engaging the panel and holding the contact in position thereon. A bight edge is formed between the arms of the contact at the closed end of the tapered slot. The bight edge is defined by an enlargement of the slot.

Other objects, features and advantages of the invention will be apparent from the following detailed description taken in connection with the accompanying drawings.

DETAILED DESCRIPTION OF THE INVENTION

Figure 1:
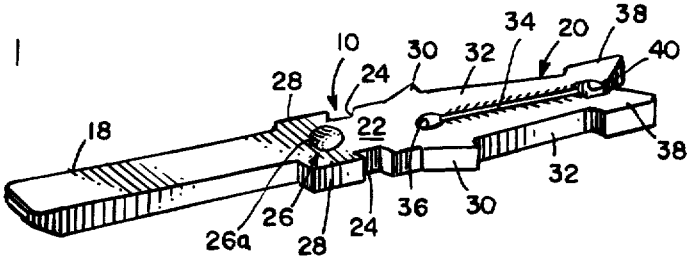
FIG. 1 is a perspective view of an electrical contact in accordance with the present invention.

Referring to the drawings in greater detail, the electrical contact of the present invention is generally designated 10 and is adapted for termination to an electrical conductor, generally designated 12 (FIGS. 4 through 7). The electrical conductor 12 shown in the drawings comprises an insulated wire having an electrically conductive core 14 surrounded by an outer coating or covering 16 of insulative material.

The electrical contact 10 of the present invention includes an active contact element 18 at one end thereof, a terminal element, generally designated 20, at the other end thereof, and an intermediate portion, generally designated 22, between the active contact element 18 and the terminal element 20.

Figure 2:
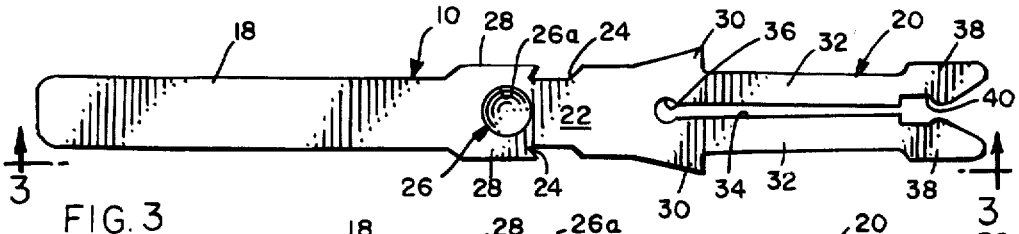
FIG. 2 is a plan view, on an enlarged scale, of the electrical contact of FIG. 1.
Figure 3:
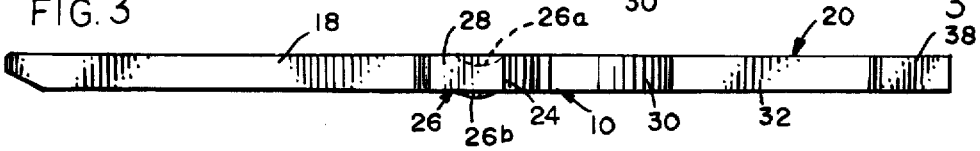
FIG. 3 is a side elevational view of the contact looking generally in the direction of line 3—3 of FIG. 2.
Figure 4:
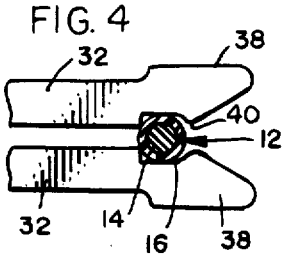
FIG. 4 is a fragmented plan view, on a further enlarged scale, of the distal end of the terminal element of the contact, with an insulated conductor disposed within the mouth of the contact.

The active contact element 18 is of a spade-type, and the intermediate portion 22 of the contact is designed for mounting the contact in an array thereof on a mounting panel or the like, not shown in the drawings. More particularly, the intermediate portion 22 of the contact includes a pair of notches 24 formed on opposite sides of the contact and into which the edges of appropriate apertures in the mounting panel are disposed. The intermediate portion 22 of the contact also includes detent means, generally designated 26, formed thereon for engaging one side of the panel, not only to further facilitate holding the contact in mounting position on the panel, but to provide one sided positioning when the contact is assembled to the panel so that all of the contacts will be aligned and bear against one side of the panel. The notches 24 are defined by a pair of opposed ears 28 which protrude outwardly from the contact adjacent the detent means 26, and a second pair of opposed ears 30 which flare outwardly from the contact on the other side of the notches 24. The conformation and dimension of the contact are shown best in the plan view shown in FIG. 2.

The electrical contact of the present invention is generally flat and may be stamped from thin sheet metal material or the like to provide a unitary construction, including the active contact element 18, the intermediate portion 22, and the terminal element 20. The detent means 26 can be stamped directly into the contact, resulting in a depression **26*a* on one side of the contact and a nipple 26*b* diametrically disposed on the other side of the contact opposite the depression 26*a***.

The terminal element 20 of the electrical contact of the present invention includes a pair of elongated, spaced conductor engaging arms 32 disposed generally in a common plane and having inside edges 34 which define an elongated tapered slot extending inwardly from the distal end of the terminal element 18 for receiving the electrical conductor 12. The slot defined by the inside edges 34 of the arms 32 is uniformly tapered and diverges inwardly from the distal end of the terminal element 20 and terminates in a bight edge defined by an enlarged circular aperture 36 at the closed end of the slot. The arms have a generally uniform or constant cross section extending substantially the entire length of the tapered slot. A pair of opposed, enlarged ears 38 are formed on the distal ends of the arms 32 and define an enlarged mouth 40 at the distal end of the terminal element 20 of the contact.

As shown by the dashed lines in FIG. 1, the arms 32 of the terminal element 20 of the contact are beveled along the edges 34 to provide insulation piercing means on the arms along the slot defined by the edges 34, for piercing the insulation 16 about the conductor 12 as the conductor is progressively moved or driven into the slot generally in the direction of arrow A (FIG. 5), as will be described in greater detail hereinafter.

The tapered conformation of the slot as it diverges inwardly from the distal ends of the arms 32 or the terminal element 20 is effective to preclude excessive forces of the arms 32 on the conductor 12 as the conductor is progressively moved into the slot. As stated hereinbefore, with electrical contacts heretofore known in the art, insulation piercing arms or fingers oftentimes are prone to not only pierce the insulation 16 about the core 14 of the conductor 12, but oftentimes to actually cut into the core 14 resulting in damage thereto creating a weak spot in the conductor. In addition, by cutting into the core 14 of the conductor, the electrical properties of the conductor are changed due to the damage to or change in cross sectional area of the core. It is apparent that when utilizing insulation piercing arms or fingers having slots therebetween for receiving the conductor, the forces on the conductor by the arms increase as the conductor is progressively moved toward the closed end of the slot. This is true because of the fact that the resiliency of the arms decreases as the arms decrease in length. In other words, a lesser force is required to flex the arms at the open end of the slot than the closed end thereof, resulting in non-uniform forces applied to the conductor as the conductor is moved into the slot. With the uniformly tapered, inwardly diverging slot of the present invention, substantially uniform normal forces are applied to the conductor as the conductor is progressively moved along the slot. Thus, the uniformed tapered slot and the controlled dimensions of the arms provide an effective means for controlling the forces of the arms on the conductor.

It has been found, in practice, that the following relationship between the slot width, conductor width, and the length of the slot or arms is effective to provide for utilization of maximum normal working forces of the arms on the conductor as the conductor is moved progressively into the slot:

$$S_w = C_d(S_1^2)X$$

Figure 5:
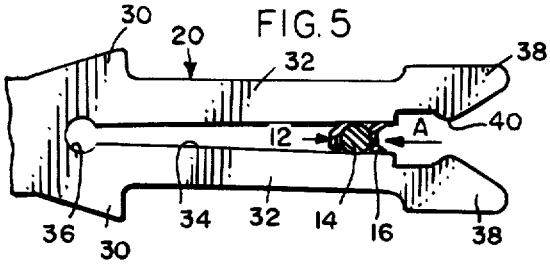
FIG. 5 is a fragmented plan view of the terminal element of the contact, with the insulated conductor initially moved into the tapered slot of the contact.
Figure 6:
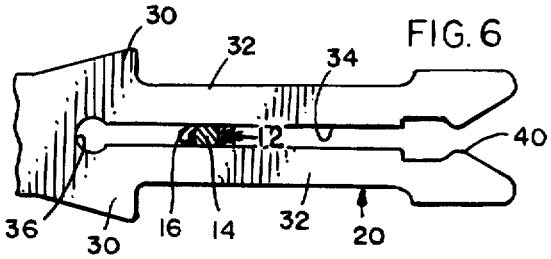
FIGS. 6 and 7 are plan views similar to FIG. 5, with the insulated conductor moved progressively into the tapered slot of the contact, with the arms of the contact fully piercing the insulation of the conductor for termination thereof.
Figure 7:
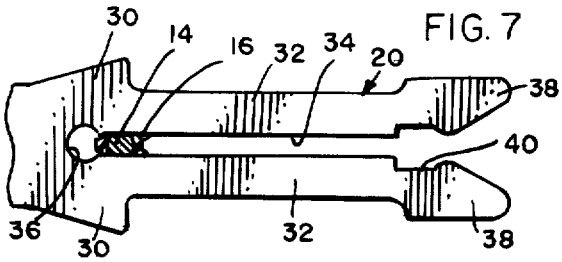

In this relation, $S_w$ equals the width of the slot at any point therealong, $C_d$ equals the diameter of the core 14 of the conductor 12, $S_1$ equals the length of the slot at any point therealong (corresponding the slot width, or $S_w$, at that point), and X equals a constant which is a function of the material of the core 14 of the conductor 12. In practice, the length, $S_1$ of the slot in the contact 10 shown in the drawings, is determined as the longitudinal dimension along the contact arms 32 generally from the center of the enlarged circular aperture 36 at the closed end of the slot to the determinating point along the arms. With this relationship, the forces of the arms 32 on the conductor 12 remains substantially constant as the conductor is moved progressively along the slot. The insulation 16 about the conductor is initially pierced as the conductor enters the slot, as shown in FIG. 5. As the conductor is progressively moved into the slot as shown in FIGS. 6 and 7, a firm conductive engagement is established between the arms 32 and the core 14 of the conductor 12 as the conductor is moved toward the closed end of the slot, as shown in FIG. 7. Due to the uniformly tapered conformation of the slot, and the controlled substantially uniform cross sectional dimensioning of the arms 32, excessive forces of the arms 32 on the conductor is precluded as the conductor is progressively moved into the slot toward the position shown in FIG. 7, and no damage is caused to the core by the beveled edges 34 along the slot. Actually, with the above relation, the normal forces between the arms 32 and the conductor can increase slightly as the conductor is moved into the slot without damaging the core 14, but for practical purposes, the forces should not increase sufficiently to cause damage to the core 14 of the conductor.

While in the foregoing specification a detailed description of the invention has been set forth for purposes of illustration, variations of the details herein given may be made by those skilled in the art without departing from the spirit and scope of the invention as set forth in the appended claims.

I claim:

1. An electrical contact for termination to an electrical conductor, comprising:

a body portion having an open-ended slotted terminal element at one end adapted to be terminated to a conductor, said terminal element including a pair of spaced conductor engaging arms disposed generally in a common plane and having inside edges which define a generally uniformly tapered, inwardly diverging slot portion beginning at the open end of said slotted terminal element and extending inwardly therefrom for receiving the conductor, said conductor engaging arms having a generally uniform cross-section extending substantially the entire length of said slot portion whereby said inwardly diverging slot portion cooperates with said arms to provide substantially uniform normal forces on the conductor as the conductor is moved inwardly from said open end along the length of said tapered slot portion for termination purposes.

2. The electrical contact of claim 1 wherein said inside edges of said arms are beveled to provide insulation piercing means on said arms for piercing insulation about said conductor.

3. The electrical contact of claim 1 including an enlarged mouth at the distal end of said terminal element and in communication with said tapered slot for dressing a conductor into the mouth prior to terminating the conductor within said slot.

4. The electrical contact of claim 1 including a bight edge between said arms at the inner end of said tapered slot, said bight edge being defined by a generally circular enlargement of said slot.

5. The electrical contact of claim 1 wherein said arms are generally thin and stamped from sheet metal or the like.

6. The electrical contact of claim 1 wherein said contact is unitary, generally flat and stamped from sheet metal or the like.

7. The electrical contact of claim 6 including an intermediate portion between said active contact portion and said terminal portion, said intermediate portion including mounting means for facilitating mounting the contact on a panel or the like.

8. The electrical contact of claim 7 wherein said inside edges of said arms are beveled to provide insulation piercing means on said arms for piercing insulation about said conductor.

9. The electrical contact of claim 1 including an intermediate portion between said active contact portion and said terminal portion, said intermediate portion including mounting means for facilitating mounting the contact on a panel or the like.

10. The electrical contact of claim 9 including detent means on said intermediate portion for engaging said panel or the like.

11. An electrical contact for termination to an electrical conductor, comprising:

a body portion stamped from generally flat sheet metal material or the like and having an open-ended slotted terminal element at one end adapted to be terminated to a conductor, said terminal element including a pair of spaced conductor engaging arms having inside edges which define a generally uniformly tapered, inwardly diverging slot portion beginning at the open end of said slotted terminal element and extending inwardly therefrom for receiving the conductor, said conductor engaging arms having a generally uniform cross section extending substantially the entire length of said slot portion whereby the tapered conformation of the slot portion and the uniform cross sectional dimensioning of said arms are effective to preclude excessive forces of said arms on the conductor as the conductor is progressively moved inwardly from said open end along the length of said tapered slot portion, and an enlarged mouth at the distal end of said terminal portion and in communication with said tapered slot portion for dressing a conductor into said mouth prior to terminating the conductor within the slot.

12. The electrical contact of claim 11 wherein said inside edges of said arms are beveled to provide insulation piercing means on said arms for piercing insulation about said conductor.

13. The electrical contact of claim 11 including a bight edge between said arms at the inner end of said tapered slot, said bight edge being defined by an enlargement of said slot.

14. The electrical contact of claim 11 including an intermediate portion between said active contact portion and said terminal portion, said intermediate portion including mounting means for facilitating mounting the contact on a panel or the like.

15. The electrical contact of claim 14 including detent means on said intermediate portion for engaging said panel or the like.

16. An electrical contact for termination to an electrical conductor, comprising:

a body portion stamped from generally flat sheet metal material or the like and having an open-ended slotted terminal element at one end adapted to be terminated to a conductor, said terminal element including a pair of spaced conductor engaging arms having inside edges which define a generally uniformly tapered, inwardly diverging slot portion beginning at the open end of said slotted terminal element and extending inwardly therefrom for receiving the conductor, said conductor engaging arms having a generally uniform cross section extending substantially the entire length of said slot portion whereby the tapered conformation of the slot portion and the uniform cross sectional dimensioning of said arms are effective to preclude excessive forces of said arms on the conductor as the conductor is progressively moved inwardly from said open end along the length of said tapered slot portion, said inside edges of said arms being beveled to provide insulation piercing means on said arms for piercing insulation about said conductor.

17. The electrical contact of claim 16 including a bight edge between said arms at the inner end of said tapered slot, said bight edge being defined by an enlargement of said slot.

18. The electrical contact of claim 16 including an intermediate portion between said active contact portion and said terminal portion, said intermediate portion including mounting means for facilitating mounting the contact on a panel or the like.

19. The electrical contact of claim 18 including detent means on said intermediate portion for engaging said panel or the like.

20. An electrical contact for termination to an electrical conductor, comprising:

a body portion stamped from generally flat sheet metal material or the like and having an open-ended slotted terminal element at one end adapted to be terminated to a conductor, said terminal element including a pair of spaced conductor engaging arms having inside edges which define a generally uniformly tapered, inwardly diverging slot portion beginning at the open end of said slotted terminal element and extending inwardly therefrom for receiving the conductor, said conductor engaging arms having a generally uniform cross section extending substantially the entire length of said slot portion whereby the tapered conformation of the slot portion is effective to preclude excessive forces of said arms on the conductor as the conductor is progressively moved inwardly from said open end along the length of said tapered slot portion.

21. The electrical contact of claim 20 including a bight edge between said arms at the inner end of said tapered slot, said bight edge being defined by an enlargement of said slot.

22. The electrical contact of claim 20 including an intermediate portion between said active contact portion and said terminal portion, said intermediate portion including mounting means for facilitating mounting the contact on a panel or the like.

23. The electrical contact of claim 22 including detent means on said intermediate portion for engaging said panel or the like.

24. In an electrical contact having an open-ended slotted terminal portion, said slotted terminal portion being formed by a pair of spaced conductor engaging arms having inside edges which define a generally uniformly tapered, inwardly diverging elongated slot means beginning at the open end of said slotted terminal element and extending inwardly therefrom for receiving a conductor, said conductor engaging arms having a generally uniform cross-section extending substantially the entire length of said slot portion whereby said slot means cooperates with said arms for providing substantially uniform normal forces on the conductor as the conductor is moved inwardly from said open end along the slot for termination purposes.

25. The electrical contact of claim 24 wherein said inside edges of said arms are beveled to provide insulation piercing means on said arms for piercing insulation about said conductor.

26. The electrical contact of claim 24 including an enlarged mouth at the distal end of said terminal element and in communication with said tapered slot for dressing a conductor into the mouth prior to terminating the conductor within said slot.

* * * * *